US006549879B1

(12) United States Patent
Cullick et al.

(10) Patent No.: US 6,549,879 B1
(45) Date of Patent: Apr. 15, 2003

(54) DETERMINING OPTIMAL WELL LOCATIONS FROM A 3D RESERVOIR MODEL

(75) Inventors: Alvin S. Cullick, Dallas, TX (US); Sriram Vasantharajan, Plano, TX (US); Mark W. Dobin, Coppell, TX (US)

(73) Assignee: Mobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/399,857

(22) Filed: Sep. 21, 1999

(51) Int. Cl.[7] ..... G06F 17/10; G06F 19/00
(52) U.S. Cl. ..... 703/10; 703/2; 702/11
(58) Field of Search ..... 703/2, 10; 702/11, 702/12, 13

(56) References Cited

U.S. PATENT DOCUMENTS

| | | | | |
|---|---|---|---|---|
| 4,249,776 A | | 2/1981 | Shuck et al. | 299/4 |
| 4,916,616 A | * | 4/1990 | Freedman et al. | 702/13 |
| 5,012,675 A | | 5/1991 | Koller et al. | 73/432.1 |

(List continued on next page.)

OTHER PUBLICATIONS

Tripp et al., A.C. Three–Dimensional Electromagnetic Cross–Well Inversion, IEEE Transactions on Geoscience and Remote Engineering, vol. 31, No. 1, Jan. 1993, pp. 121–126.*

Barhen, J. Reduction of Uncertainties in Neural Network Prediction of Oil Well Logs, Proceedings of the 2002 International Joint Conference on Neural Networks, 2002, IJCNN '02, pp. 902–907.*

Cai, Haou, Xu, Liu and Xu; *Methodologies and Realization of Reservoir Petrophysics Analysis by Well Logging*, Petroleum University, Dongying, China; Jun. 1996, pp. 12–18 (Abstract only available).

(List continued on next page.)

*Primary Examiner*—Russell Frejd

(57) ABSTRACT

There is disclosed herein a systematic, computationally-efficient, two-stage method for determining well locations in a 3D reservoir model while satisfying various constraints including: minimum interwell spacing, maximum well length, angular limits for deviated completions, and minimum distance from reservoir and fluid boundaries. In the first stage, the wells are placed assuming that the wells can only be vertical. In the second stage, these vertical wells are examined for optimized horizontal and deviated completions. This solution is expedient, yet systematic, and it provides a good first-pass set of well locations and configurations. The first stage solution formulates the well placement problem as a binary integer programming (BIP) problem which uses a "set-packing" approach that exploits the problem structure, strengthens the optimization formulation, and reduces the problem size. Commercial software packages are readily available for solving BIP problems. The second stage sequentially considers the selected vertical completions to determine well trajectories that connect maximum reservoir pay values while honoring configuration constraints including: completion spacing constraints, angular deviation constraints, and maximum length constraints. The parameter to be optimized in both stages is a tortuosity-adjusted reservoir "quality". The quality is preferably a static measure based on a proxy value such as porosity, net pay, permeabilty, permeability-thickness, or pore volume. These property volumes are generated by standard techniques of seismic data analysis and interpretation, geology and petrophysical interpretation and mapping, and well testing from existing wells. An algorithm is disclosed for calculating the tortuosity-adjusted quality values.

25 Claims, 6 Drawing Sheets

U.S. PATENT DOCUMENTS

| | | | | | |
|---|---|---|---|---|---|
| 5,706,194 | A | * | 1/1998 | Neff et al. | 702/14 |
| 5,757,663 | A | | 5/1998 | Lo et al. | 364/509 |
| 6,035,255 | A | | 3/2000 | Murphy et al. | 702/11 |
| 6,044,328 | A | * | 3/2000 | Murphy et al. | 702/11 |
| 6,070,125 | A | | 5/2000 | Murphy et al. | 702/11 |
| 6,266,619 | B1 | * | 7/2001 | Thomas et la. | 702/13 |

OTHER PUBLICATIONS

Seifert, D., Lewis, J.J.M., and Hern, C.Y. "*Well Placement Optimisation and Risking Using 3–D Stochastic Reservoir Modelling Techniques*", European 3–D Reservoir Modelling Conference, Stavanger, Norway (Apr. 16–17, 1996) Paper No. SPE 35520, pp. 289–300.

Hird, K.B. and Dubrule, O. "*Quantification of Reservoir Connectivity for Reservoir Description Applications*", SPE Annual Technical Conference & Exhibition, Dallas, Texas (Oct. 22–25, 1995) Paper No. SPE 30571, pp. 415–424.

Beckner, B.L. and Song, X. "*Field Development Planning Using Simulated Annealing—Optimal Economic Well Scheduling and Placement*", SPE Annual Technical Conference & Exhibition, Dallas, Texas (Oct. 22–25, 1995) Paper No. SPE 30650, pp. 209–221.

Deutsch, Clayton V. "*Fortran Programs for Calculating Connectivity of Three–Dimensional Numerical Models and for Ranking Multiple Realizations*", Computers & Geosciences, vol. 24, No. 1 (1998) pp. 69–76.

Gutteridge and Gawith, D.E. "*Connected Volume Calibration for Well–Path Ranking*", European 3D Reservoir Modelling Conference, Stavanger, Norway (Apr. 16–17, 1996) Paper No. SPE 35503, pp. 197–206.

Vasantharajan, S. and Cullick A.S. "*Well Site Selection Using Integer Programming Optimization*", So. IAMG Annual Meeting, Barcelona (Sep. 1997) pp. 421–426.

Rosenwald, Gary W. and Green, Don W. "*A Method for Determining the Optimum Location of Wells in a Reservoir Using Mixed–Integer Programming*", Society of Petroleum Engineers Journal, (Feb. 1974) pp. 44–54.

Ierapetritou, M.G., Floudas, C.A., Vasantharajan, S., and Cullick, A.S. "*Optimal Location of Vertical Wells: Decomposition Approach*", AIChE Journal, vol. 45, No. 4 (Apr. 1999) pp. 844–859.

* cited by examiner

DETERMINING OPTIMAL WELL LOCATIONS FROM A 3D RESERVOIR MODEL

BACKGROUND OF THE INVENTION

1. Field of the Invention

The present invention relates generally to methods for minimizing the costs of extracting petroleum from underground reservoirs. More specifically, the present invention relates to determining optimal well placement from a three-dimensional model of an underground reservoir.

2. Description of the Related Art

A critical function of reservoir management teams is the generation of a reservoir development plan with a selection of a set of well drilling sites and completion locations that maximizes productivity. Generation of the plan generally begins with a set of reservoir property maps and a set of infrastructure constraints. The team typically includes geologists, geophysicists, and engineers who choose well locations using reservoir models. The wells are located to optimize some desired property of the reservoir that is related to hydrocarbon productivity. In the early development of a field, these models might consist of porosity or lithology maps based primarily on seismic interpretations tied to a few appraisal wells. Once given the model, the team is often asked to quickly propose a set of locations that maximize production. Complicating this endeavor is the requirement that the selected sites obey a set of constraints, e.g. minimum interwell spacing, maximum well length, minimum distance from :fluid contacts or reservoir boundaries, and well configuration constraints. The combined problem is highly combinatorial, and therefore time consuming to solve. This is especially true for reservoirs that are heterogeneous with disconnected pay zones. Practical solutions to this problem typically involve evaluating a small subset of the possible well site combinations as case studies, and then selecting those with the highest value of the desired productivity metric, e.g. net pay or permeability-thickness (represented as "quality").

As a reservoir is developed with production wells, a more comprehensive reservoir model is built with detailed maps of stratigraphy and pay zones. Pressure distribution maps or maps of fluid saturation from history matching may also become available. Then, proposing step-out or infill wells requires the additional consideration of constraints imposed by performance of the existing wells. Thus, the choice of selecting well locations throughout the development of a reservoir can become increasingly complicated. Again, this is especially true for reservoirs that are heterogeneous with disconnected pay zones. Finding solutions to the progressively-more complex well placement problem can be a tedious, iterative task.

There have been several reported studies that have attempted to use ad hoc rules and mathematical models to determine new well locations and/or well configurations in producing fields. The following publications are hereby incorporated herein by reference:

1. Seifert, D., Lewis, J. J. M., Hern, C. Y., and Steel, N. C. T., "Well Placement Optimisation and Risking using 3-D Stochastic Reservoir Modelling Techniques", SPE 35520, presented at the NPF/SPE Europeanf Reservoir Modelling Conference, Stavanger, April 1996.
2. P. A. Gutteridge and D. E. Gawith, "Connected Volume Calibration for Well Path Ranking", SPE 35503, European 3D Reservoir Modelling Conference, Stavanger, Apr. 16–17, 1996.

3. Rosenwald, G. W., and Green, D. W., "*A Method for Determining the Optimum Location of Wells in a Reservoir Using Mixed-Integer Programming*", SPE J., (1973).
4. Lars Kjellesvik and Geir Johansen, "*Uncertainty Analysis of Well Production Potential, Based on Streamline Simulation of Multiple Reservoir Realisations*", EAGE/SPE Petroleum Geostatistics Symposium, Toulouse, April 1999.
5. Beckner, B. L. and Song X., "*Field Development Planning Using Simulated Annealing— Optimal Economic Well Scheduling and Placement*", SPE 30650, Annual SPE Technical Conference and Exhibition, Dallas, Oct. 22–25, 1995.
6. Vasantharajan S. and Cullick, A. S., "*Well Site Selection Using Integer Programming Optimization*", IAMG Annual Meeting, Barcelona, September 1997.
7. Ierapetritou, M. G., Floudas, C. A., Vasantharajan, S., and Cullick, A. S., "A Decomposition Based Approach for Optimal Location of Vertical Wells", AICHE Journal 45, April, 1999, p. 844–859.
8. K. B. Hird and O. Dubrule, "Quantification of reservoir Connectivity for Reservoir Description Applications", SPE 30571, 1995 SPE Annual Technical Conference and Exhibition, Formation Evaluation and Reservoir Geology, Dallas, Tex.
9. C. V. Deutsch, "Fortran Programs for Calculating Connectivity of three-dimensional numerical models and for ranking multiple realizations," Computers & Geosciences, 24(1), p. 69–76.
10. Shuck, D. L., and Chien, C. C., "*Method for optimal placement and orientation of wells for solution mining*", U.S. Pat. No. 4,249,776, Feb. 10, 1981.
11. Lo, T. S., and Chu, J., "*Hydorcarbon reservoior connectivity tool using cells and pay indicators*", U.S. Pat. No. 5,757,663, Mar. 26, 1998.

Seifert et al[1] presented a method using geostatistical reservoir models. They performed an exhaustive "pin cushioning" search for a large number of candidate trajectories from specified platform locations with a preset radius, inclination angle, well length, and azimuth. Each well trajectory was analyzed statistically with respect to intersected net pay or lithology. The location of candidate wells was not a variable; thus, the procedure finds a statistically local maximum and is not designed to meet multiple-well constraints.

Gutteridge and Gawith[2] used a connected volume concept to rank locations in 2D but did not describe the algorithm. They then manually iterated the location and design of wells in the 3D reservoir model. This is a "greedy" approach that does not accommodate the constraints on well locations, and the selection of well sites is done in 2D. Both this and the previous publication are ad hoc approaches to the problem.

Rosenwald and Green[3] presented an Integer Programming (IP) formulation to determine the optimum location of a small number of wells. He assumed that a specified production versus time relationship is known for the reservoir and that the potential locations for the new wells are predetermined. The algorithm then selected a specified number of wells from the candidate locations, and determined the proper sequence of rates from the wells.

Kjellesvik and Johansen[4] ranked wells' drainable volumes by use of streamlines for pre-selected sites. The streamlines provide a flow-based indicator of the drainage capability, and although streamline simulation is significantly faster than a full finite-difference simulation, the number of required operations in an optimization scheme, e.g. simulated annealing or genetic algorithm, is still $O(N^2)$, where N is the number of active grid cell locations in the model. The compute time is prohibitive when compared with using a static measure. Beckner and Song[5] also used flow simulation tied with a global optimization method, but they were only able to perform the optimization on very small data volumes.

Vasanthrajan and Cullick[6] presented a solution to the well site selection problem for two-dimensional (2D) reservoir maps as a computationally efficient linear, integer programming (IP) formulation, in which binary variables were used to model the potential well locations. This formulation is unsuitable for three-dimensional :data volumes. A decomposition approach was presented for larger data problems in three-dimensional (3D) maps by Ierapetritou et al[7].

Hird and Dubrule[8] used flow simulation in 2D reservoir models to assess connectivity between two well locations. This was for relatively small models in 2D and only assesses connectivity between two specific points. C. V. Deutsch[9] presents a connectivity algorithm which approaches the problem with nested searches of growing "shells". This algorithm is infeasibly slow.

Shuck and Chien[10] presented an ad hoc well-array placement method that selects the cell pattern of the well-array so that the cell area is customized and the major axis of the cells are parallel to the major axis of transmissivity of the well field. This method does not determine optimal locations for individual wells.

Lo and Chu[11] presented a method for estimating total producible volume of a well from a selected well perforation location. No optimization of the total producible volume is sought in this reference.

The above publications fail to provide a feasible method for selecting optimal or near-optimal well completion locations in a 3D reservoir model for a variety of reasons, not the least of which is the size of the problem space. Typical 3D seismic models include $10^7$–$10^8$ voxels (volumetric pixels, a.k.a. cells), and the methods described in the above publications cannot efficiently find a solution. Accordingly, a need exists for a systematic method of identifying optimal or near-optimal well locations in a three-dimensional reservoir model. Preferably, the method would be computationally efficient, and would account for the sophisticated drilling technology available today that allows horizontal and/or highly deviated completions of variable lengths which can connect multiple high-pay locations.

SUMMARY OF THE INVENTION

There is disclosed herein a systematic, computationally-efficient, two-stage method for determining well locations in a 3D reservoir model while satisfying various constraints including: minimum interwell spacing, maximum well length, angular limits for deviated completions, and minimum distance from reservoir and fluid boundaries. In the first stage, the wells are placed assuming that the wells can only be vertical. In the second stage, these vertical wells are examined for optimized horizontal and deviated completions. This solution is expedient, yet systematic, and it provides a good first-pass set of well locations and configurations.

The first stage solution formulates the well placement problem as a binary integer programming (BIP) problem which uses a "set-packing" approach that exploits the problem structure, strengthens the optimization formulation, and reduces the problem size. Commercial software packages are readily available for solving BIP problems. The second stage sequentially considers the selected vertical completions to determine well trajectories that connect maximum reservoir pay values while honoring configuration constraints including: completion spacing constraints, angular deviation constraints, and maximum length constraints. The parameter to be optimized in both stages is a tortuosity-adjusted reservoir "quality". The quality is preferably a static measure based on a proxy value such as porosity, net pay, permeabilty, permeability-thickness, or pore volume. These property volumes are generated by standard techniques of seismic data analysis and interpretation, geology and petrophysical interpretation and mapping, and well testing from existing wells. An algorithm is. disclosed for calculating the tortuosity-adjusted quality values.

BRIEF DESCRIPTION OF THE DRAWINGS

A better understanding of the present invention can be obtained when the following detailed description of the preferred embodiment is considered in conjunction with the following drawings, in which.

Figure 1:
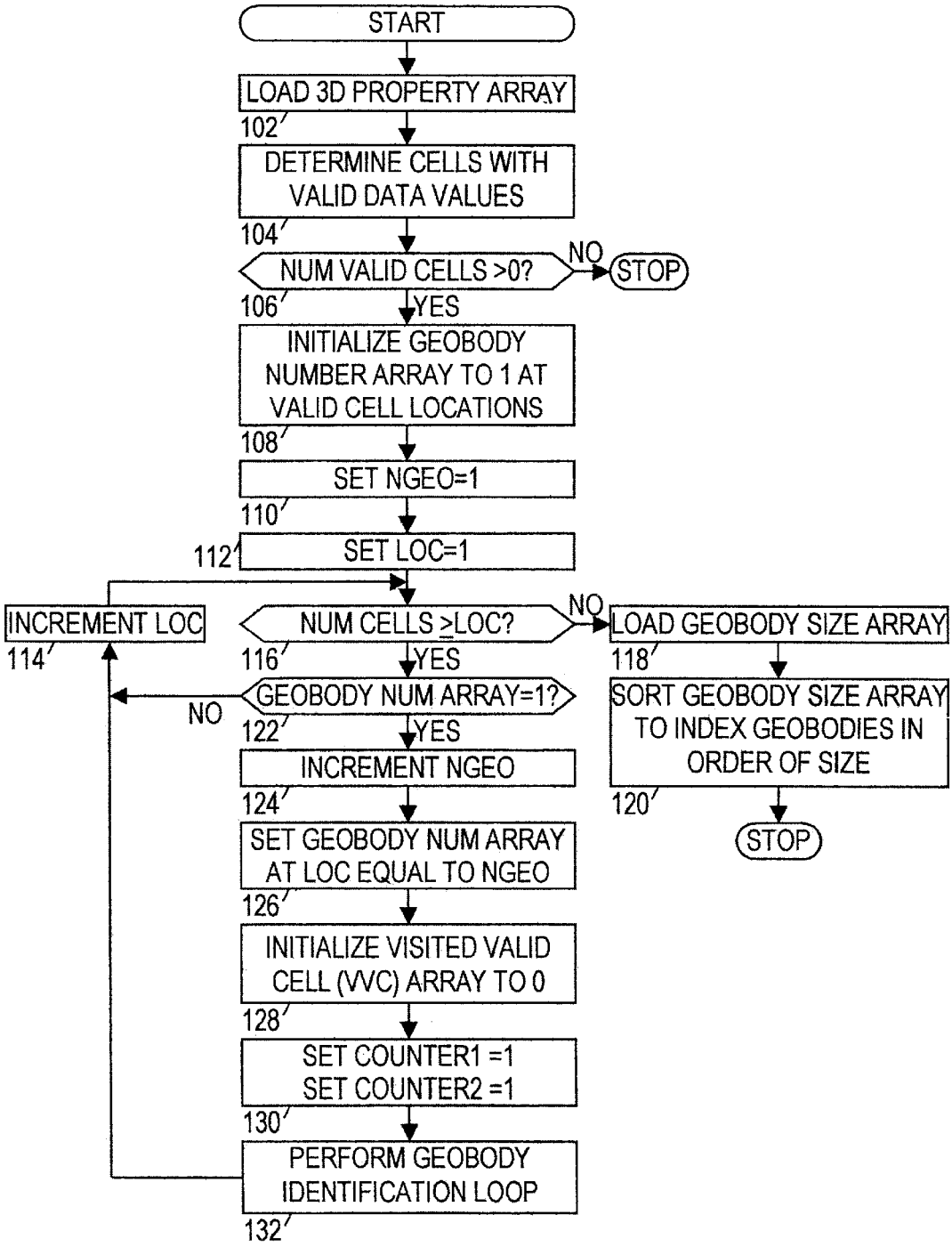
FIGS. 1 and 2 are a flowchart of a geobody identification method.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENT

For explanatory purposes, the following discussion focuses on the well site selection issues faced by a reservoir management team during the initial stages of a project development, where the wells are sited to maximize productivity while honoring the constraints. It is recognized that the disclosed method and techniques are applicable to a much wider variety of problems, and the following discussion is not intended to limit the scope of the claimed invention.

Static Metric For Reservoir Productivity

The measure of reservoir productivity during the initial project stage is normally chosen to be a static metric of the reservoir productivity, e.g. net pay (defined as porosity×thickness×area×net-to-gross×hydrocarbon saturation), permeability-thickness, or a combination. In other words, underground fluid movements are most often not considered in determining well location at this field development stage. The focus is on modeling the spatial and configurational constraints such as minimum interwell spacing, maximum well length, angular limits for deviated completions, total capital available or maximum number of wells and minimum distance from reservoir and fluid boundaries, distance from offshore platforms or drilling pads that have to be factored into the choice of these locations. Subsequent detailed flow simulation may then be conducted to determine an appropriate production policy from these well candidates to meet desired production targets.

For the preferred embodiment, the static measure is reservoir "quality", or more preferably, tortuosity-adjusted reservoir quality. The. reservoir quality calculation is based on some property measurement that can serve as a proxy for the amount or producibility of hydrocarbons available for extraction by a well. Examples of suitable: well production proxy measurements include: porosity, net pay, permeability, permeability thickness, and pore volume. Standard techniques exist in the fields of seismic analysis and interpretation, geology and petrophysical interpretation and mapping, and well testing, to determine such values for each volumetric cell (hereafter termed "voxel") of a 3D reservoir model.

The reservoir quality of a given voxel is calculated by summing the connected proxy measurement values within an estimated drainage radius of a prospective well of the given voxel. The proxy measurement values may optionally be multiplied by the associated voxel volumes prior to the summation. For example, if the proxy value is porosity, then the quality represents the summed connected pore volume within the assumed drainage radius. If the proxy value is net pay (defined as the product of porosity, hydrocarbon saturation, volume, and a net-to-gross ratio), then the quality is equivalent to producible hydrocarbon volume in the volume connected to the given voxel. Quality may be a better proxy to productivity than porosity alone, as porosity is a strictly local measure, whereas quality assesses the connected pore volume. The method of Lo and Chu[11] may be adapted to the present application, but a more preferred quality calculation method is described below.

One of the issues addressed by the preferred quality calculation method is tortuosity. In reservoirs with many boundaries, sinuous channels, or pay that is interspersed with shale or diagentically altered rock, the actual flow streamlines in a volume can be tortuous. Accounting for tortuosity associated with the proxy measurements improves the reliability of the static measure.

The preferred embodiment of the disclosed method calculates reservoir quality by first "trimming" proxy measurement values below a chosen cutoff value. This may be accomplished by assigning proxy measurement values of zero to voxels having values below the cutoff, or alternatively by designating such voxels as "inactive". A connectivity algorithm is then executed to identify collections of connected, active (nonzero) voxels. These collections are hereafter termed geobodies.

The proxy measurement values are generated from "data volumes" of measured properties (e.g. amplitude, impedance, porosity, and porosity-thickness) that can contain 10's to 100's of millions of data values. Evaluation of reservoir connectivity has traditionally been tedious. In the past, geoscientists have had available a tool to identify a single connected body, given a seed point such as a location on a wellbore. Each body had to be identified and rendered visually one at a time. For large volumes with many bodies, e.g. ~$10^5$, this process has been known to take many hours, and even days or weeks. Previous automatic algorithms for geobody detection have been tried. The problem has been their slow computation for data, volumes of large size. For example, Gutteridge and Gawith[2] did their geobody detection for 3D models in 2D "shells" to make a practical computation. Deutsch's[9] algorithms produce the following computation times (the computation time increases by about three orders of magnitude for each order of magnitude increase in the number of grid cells).

| Data volume size in grid cells | Compute time in seconds (Ref. 9) |
|---|---|
| $10^4$ | <1 |
| $10^5$ | 10 |
| $10^6$ | $10^3$ |
| $10^7$ | ~$10^6$ (extrapolated) |

In comparison, the connectivity algorithm disclosed herein has an approximately linear increase with volume size. The compute time depends on the number of active grid cells and the number of separate geobodies. A few examples are given in the following table.

| Data volume size in grid cells | Approximate compute time in seconds |
|---|---|
| $4 \times 10^6$ | 120 |
| $3 \times 10^7$ | 600 |
| $1.2 \times 10^8$ | 1200 |

The algorithm quickly determines the internal connectivity within a large 3D data volume. The connected bodies, referred to as geobodies are indexed by size, which allows them to be selected individually or in groups to be rendered visually.

Figure 2:
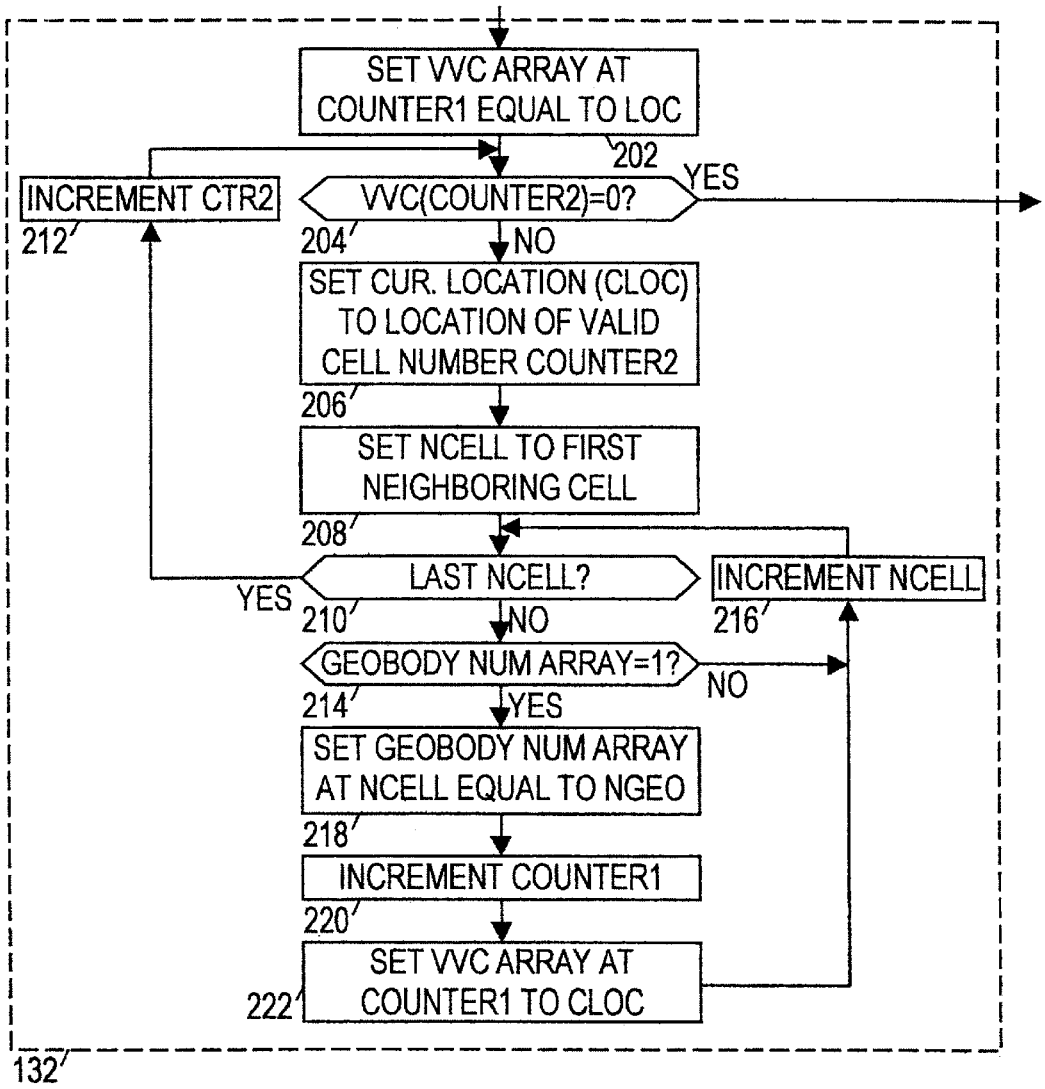

The preferred connectivity algorithm is specified by FIGS. 1 and 2. Starting with block 102, the algorithm instructs a computer to load the 3D array of measured properties. In block 104, the 3D array is processed to determine which cells are "valid". Cells are valid if the associated properties are within a specified measurement range (e.g..the measured property value is greater than a specified cutoff value). If no cells are valid, the algorithm terminates in block 106. Otherwise, in block 108 a geobody number array having the same dimensions as the 3D array is initialized to "1" in valid cells, and "0" in all other cells. In block 110, the number of geobodies (NGEO) is initialized to 1, and in block 112, a location index (LOC) is set to point to a first cell. In block 114, the location index will be incremented through all cells in the 3D array. In block 116, a test is made to see if all cells have been processed. If so, then in block 118 the geobody number array is processed to determine the size of each geobody,. and in block 120, the geobodies are reordered so as to be indexed by size (the first geobody will be the largest). The algorithm then terminates after block 120.

Otherwise, in block 122 a test is made to see if the cell of the geobody number array indicated by the location index is valid and not yet assigned a geobody number. If not, the location index is incremented in block 114, and control returns to block 116. Otherwise, the number of geobodies is incremented in block 124, and the cell is assigned the current geobody number in block 126. A visited valid cell (VVC) list is initialized to 0 in block 128, and two counters for that list are initialized to 1. The geobody identification loop 132 is then performed, and control subsequently loops back to block 114.

FIG. 2 shows the geobody identification loop 132. In block 202, the first element of the VVC list is set equal to the location index LOC. In block 204, a test is made to see all the elements of the VVC list have been processed. If so, control returns to block 114. Otherwise, a current location index (CLOC) is set to the location of the current element of the VVC list in block 206. A neighboring cell index (NCELL) is set equal to a first neighboring cell in block 208. Subsequently, NCELL will be indexed through all neighboring locations to CLOC in block 216. The definition of "neighboring cells" may be varied, but preferably the neighboring cells are the six cells that share a face with the CLOC cell. In block 210, a test is made to determine if all the neighboring cells have been considered. If so, counter 2 is incremented in block 212, and control returns to block 204. Otherwise, in block 214, a test is made to determine if the neighboring cell is valid and not yet assigned a geobody number. If not, then NCELL is incremented in block 216. If so, the neighboring cell is assigned the current geobody number in block 218, and blocks 220 and 222 add the neighboring cell to the VVC list. The NCELL index is then incremented in block 216. Alternative neighboring cells (Block 208) may be defined as any and all combinations of the six face-sharing cells, the additional twelve edge-sharing cells, and the additional nine corner-sharing cells. The 27-point search of all neighbor cells is preferred when the reservoir pay is thin and dip relative to the cell orientation. The six-point search of face-sharing cells is preferred when the reservoir pay is thicker than the cell thickness with little dip relative to the cell orientation. The 18-point search of neighbors is preferred for intermediate circumstances.

Figure 3:
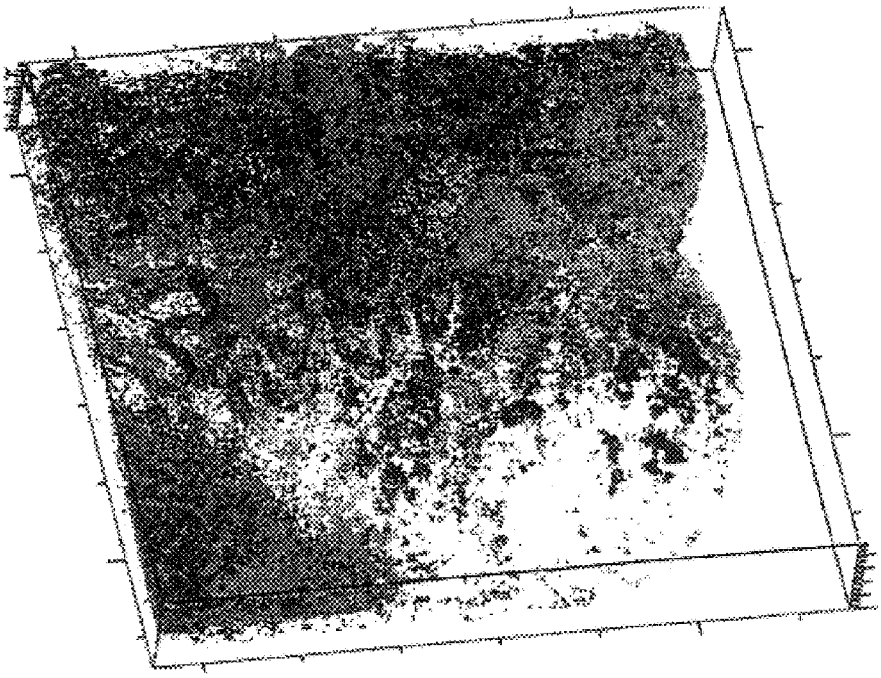
FIG. 3 is an exemplary 3D porosity data volume.
Figure 4:
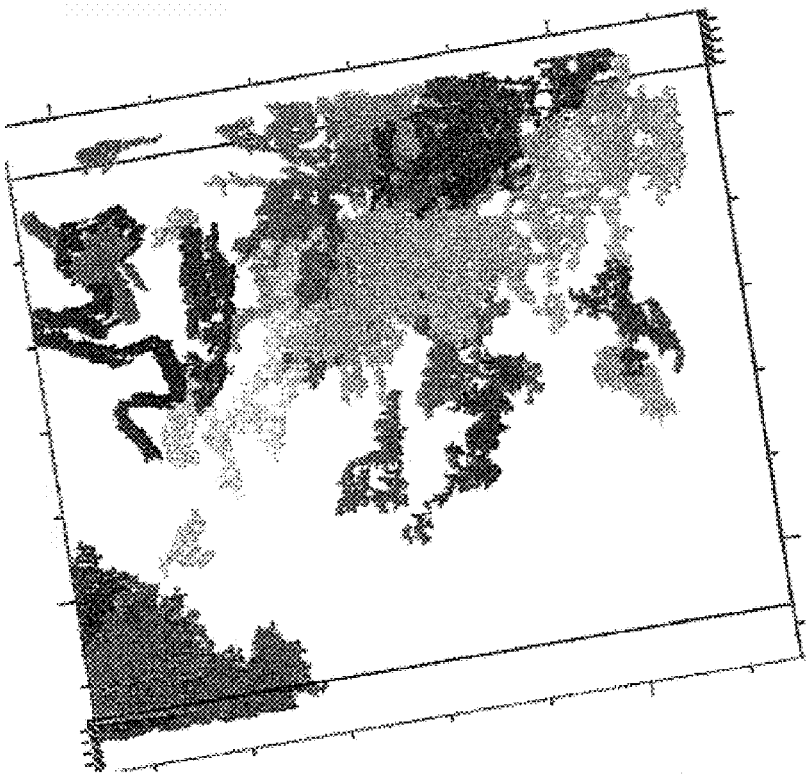
FIG. 4 is data volume showing the identified geobodies.

To calculate reservoir quality, geobodies are first generated using the disclosed connectivity algorithm. FIG. 3 shows a 3D measured property array of approximately 30 million cells. This array is a porosity volume (i.e. the measured property is porosity). The array is 351×351×241 cells, and each cell is approximately 29 meters×29 meters×3 meters. The original seismic amplitude data were converted to a resistivity volume and a fraction of shale volume $V_{shale}$ using neural networks calibrated with well log data. The porosity volume is an estimate based on a combination of the resistivity and $V_{shade}$ using proscribed cutoffs. The porosity cutoff was 12%. Visualization of the porosity volume yields little information about the connectivity of the porosity. FIG. 4 shows the geobodies generated by the connectivity algorithm.

A reservoir quality value is calculated for each voxel of the model by summing the values of the proxy measurements within a drainage volume around each voxel that are in the same geobody as the voxel, multiplied by the voxel volumes. To adjust for the tortuosity of the actual flow streamlines, a tortuosity algorithm is used. The tortuosity algorithm utilizes a random walker to determine the extent to which noflow boundaries are contained within the drainage volume. Random walkers essentially detect the pathway lengths from each cell location to all boundaries within the drainage volume, and reduce the contribution of properties that are located farther away from the voxel in question.

Figure 5:
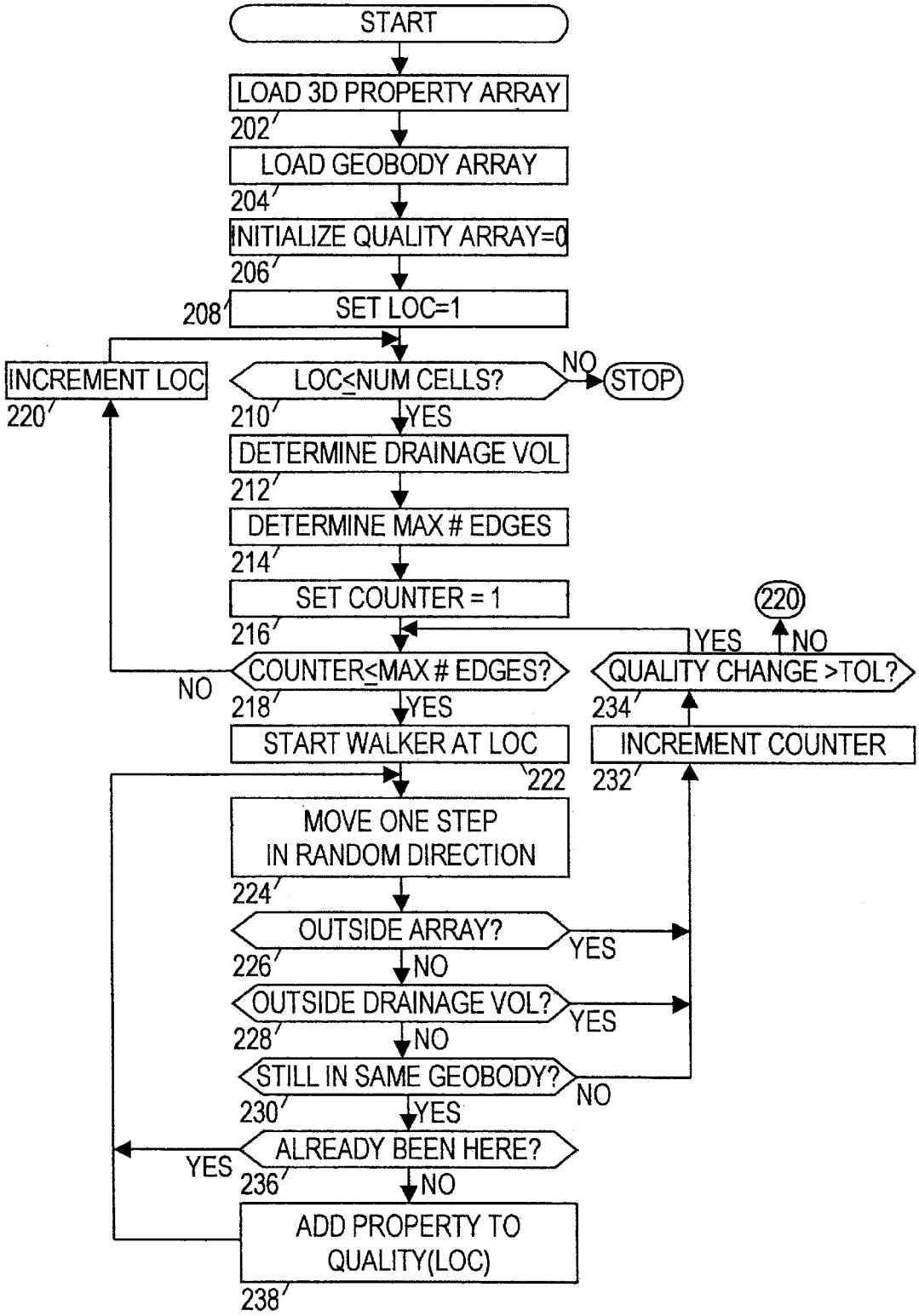
FIG. 5 is a flowchart of a reservoir quality calculation method.

FIG. 5 shows one implementation of a random walker method for calculating tortuosity-adjusted reservoir quality values. Starting with blocks 202–206, software instructs the computer to load the 3D measured property array, load the 3D geobody array from the previous algorithm, and initialize a 3D quality array to zero. These arrays share common dimensions. A location index LOC is initialized to the first cell in these arrays in block 208, and is sequentially incremented through all cells in block 220. In block 210, a test is made to see if the index has been incremented through all cells. If so, the software terminates. Otherwise, in block 212, the range of cells that could potentially be drained from the current location is determined. In a preferred embodiment, this volume is a rectangular volume of cells determined from multiplying the drainage radius by an aspect ratio in each direction. The maximum number of edges is calculated in block 214. This is preferably equal to the number of cell faces on the surface area of the drainage volume. However it is chosen, this number will be the maximum number of random-walk paths that are generated from the current location. A path counter is initialized to 1 in block 216, and in block 218, a test is made to see if the counter is less than or equal to the maximum number of edges. If not, then the software moves to the next cell location in block 220. Otherwise, a new "walker" is started at the current location in block 222. In block 224, the walker is moved one cell in a random direction. In blocks 226–230, a series of tests are made to see if the walker has moved outside the 3D array, outside the drainage volume, or outside the current geobody. If any of these are true, the software increments the path counter in block 232. Before starting a new walker, the software tests to see if the quality measurement has "saturated" in block 234. In one embodiment, the test involves testing to see if the quality value for the current location has changed by more than a predetermined tolerance over a predetermined number of paths. For example, if the quality has not changed by more than 1% in the last 100 paths, the software assumes that the quality measurement has saturated, and the software moves to the next location in block 220. If saturation has not occurred, then the software returns to block 218.

If the tests in blocks 226–230 have shown that the walker is still in the drainable volume, then in block 236, a test is made to see if the walker's current position has already been visited. If so, then the software returns to block 224 to take the next step for the walker. Otherwise, the measured property value of the current walker position is added to the quality for the current cell location before the next walker step is taken. This method of determining reservoir quality value for a cell effectively decreases the contribution of measured property values for cells that are less likely to be reached by the random walker. These cells are those cells that are further from the current cell location, and those cells that are connected to the current cell via a small "window", i.e. a tortuous pathway. An alternative embodiment would adjust the quality by the flow resistance of the path, as provided by permeability values in the cells. The productivity proxy of tortuosity-adjusted quality should differentiate well sites nearer a center of highly connected volume from those nearer its boundary.

2D Well Placement

Having now determined a static measure that is related to reservoir fluid productivity, the next step in reservoir management is the placement and configuration of wells. The objective function for well selection should maximize the set of all wells' production, while meeting specified constraints. In practice, well locations are often selected by attempting to maximize the contact with the static measure.

The mathematical model to ensure interwell spacing for such involved completions is extremely difficult to formulate, and would lead to an explosion in problem size that cannot be solved with the capability of today's computers and numerical algorithms. Therefore, the preferred method is a two-stage decomposition strategy that first solves the problem of determining completions for strictly vertical wells within the 3D-reservoir data volume. In the second stage, the vertical wells selected become candidate locations to be considered for high-grading into horizontal or highly deviated wells. This method systematically determines highly deviated trajectories that can reach disconnected high-pay areas in a given 3D volume while honoring constraints of maximum well length and deviation angles. The second stage model uses graph theory principles to provide a novel, compact framework for determining the ideal trajectory length and azimuth of a horizontal or deviated well to maximize productivity.

Because of the two-staged strategy, and the sequential nature of the high grading procedure, the final set of well configurations and locations selected cannot be proven to be strictly optimal. Still, the proposed method provides an automated procedure to quickly determine a good set of vertical and highly deviated well completions that intersect high-quality reservoir property locations, while obeying well spacing and other spatial constraints.

In the preferred method, the location of wells is formulated as a binary integer program (131P), for which the location of a take-point at a particular location in the reservoir is a 0/1 for an on/off decision. BIPs can only be solved by enumeration. Thus, severe restrictions are presented by both the numerical algorithms available and by the computing power available for solving large-scale, complex BIPs. Considerable attention has to be given to the model formulation to identify specific structures and/or features that can be exploited by the numerical algorithms to solve practical problems.

The problem can be stated in the following manner:

Let a set I, {1, 2, . . . , N} denote all potential well locations, and let indices i, j∈I. Let a binary variable $Y_i \in \{0, 1\}$ denote the existence/non-existence of a well site, and let $Q_i$ be its associated reservoir "quality" value. Associated with each well site is a known cost for drilling and completion, $C_i$. The general problem of determining well drilling sites can be expressed qualitatively as follows:

$$\text{Maximize} \sum_{i=1}^{N} Q_i Y_i - \sum_{i=1}^{N} C_i Y_i$$

subject to constraints that include: well locations, well spacing, well configuration, and capital available.

The following sections describe mathematical formulations that quantitatively model the set of constraints listed above. While these discussions focus on the development of efficient formulations to describe the "well configuration"-type constraints, it can be seen that the same techniques can be applied to characterize the other types of constraints. All the optimization models developed are flexible and scaleable, and can easily accommodate these and other constraints.

In the first stage, the 3D-reservoir quality volume is used to generate a 2D quality map. The 2D quality map is determined by setting the quality value for a cell to the maximum quality in the corresponding column of cells in the 3D volume. Each cell in the 2D array can be considered as a potential site where a well can be drilled. The 2D maps are generally on the order of a few tens of thousands of cells each. The task is to select a subset of these potential locations that will maximize the cumulative value of the property, while ensuring that the planar distance between the selected sites is over a certain specified minimum to avert well interference.

The following terms are now defined:

Let $(x_i, y_i)$ denote the known coordinates of these locations on a rectangular grid Let $D_{ij}$ be the Euclidean distance between any two well sites (i,j): $D_{ij}=\sqrt{(x_i-x_j)^2+(y_i-y_j)^2}$ Let $D_{min}$ denote the minimum desired well spacing (in grid units)

Let $N_{max}$ denote the maximum number of wells to be selected

The BIP formulation for well site selection in 2D reservoir maps can be expressed:

$$\text{Maximize} \sum_{i=1}^{N} Q_i Y_i - \sum_{i=1}^{N} C_i Y_i, \tag{1}$$

subject to the constraints:

$$\sum_{i \in I}^{N} Y_i \le N_{\max} \tag{4}$$

Equation (1) represents the total benefit and cost of placing the vertical wells. Equation (2) states that $Y_i$ is a binary variable. Equation (3) enforces the interwell spacing constraint, and Equation (4) limits the number of wells to a maximum. As Equation (3) is equivalent when i and j are interchanged, care should be taken to avoid unnecessarily duplicating constraint equations.

It is noted that equation 3 actually represents a large number of constraint equations (roughly $D^2_{min}N/2$), which causes identifying vertical well sites in typical 2D reservoir maps to be an intractably large problem. Equation 3 can be restated in another way:

$$Y_i + Y_j \le 1,\ \left\{ j \mid i \ne j,\ \frac{D_{\min}}{2} < D_{ij} \le D_{\min} \right\} \tag{5}$$

$$Y_i + \sum_{J} Y_j \le 1,\ J = \left\{ j \mid i \notin j,\ D_{ij} \le \frac{D_{\min}}{2} \right\} \tag{6}$$

In addition to significantly reducing the number of constraint equations, this formulation places many of the constraint equations in a "set-packing" form that commercial software solvers can exploit to reduce the problem space. Specifically, commercial IP solvers like CPlex© and OSL© can exploit the form of Equation 6 by "branching" on the involved binary variables as a "special order set".

3D Well Placement

With 2D reservoir maps, the focus is on ensuring that the planar distance between selected well sites was greater than a specified minimum. In 3D reservoir volumes the reservoir stratigraphic properties also exhibit variations in the vertical or i-direction: If there is sufficient variation of the reservoir property in the z-direction, one can decide to complete a well in multiple zones at varying depths. Thus, with 3D volumes, it is not sufficient to just ensure that the well drilling sites meet the distance constraints in the (x, y) plane. Additionally, one must ensure that the well completions, located along the z-direction, must also meet these constraints. Further, for horizontal or deviated wells, one must ensure that these constraints are satisfied along the entire length of the well trajectories.

The color coded objects in FIG. 4 illustrate unconnected geobodies. The "quality" of a well completed in a geobody is hereby defined as the. maximum "quality" encountered in all vertical voxels that are in the same geobody at that map location (i.e. maximum quality in a column of a geobody). The wells should have a minimum spacing of $D_{min}$ if they are completed within the same geobody. If there are disconnected reservoir flow. units, i.e., different geobodies, the wells can be spaced at less than $D_{min}$. If there are overlying Pow units that could be completed by a single wellbore, there should be a cost for multiple completions included in the objective function.

The well-site selection process models the 3D volume as a stack of 2D layers. The cells in the topmost layer which are distributed in the (x, y) domain correspond to potential well sites, as in the 2D case. Let W represent this set of potential well sites. Now, from each of these sites, as the layers are traversed down in a straight line in the z-direction, geobody voxels are encountered. There are as many potentially valid completions for each (x, y) well site as there are z-locations that intersect different geobodies (i.e. stratigraphically separate layers). Let G represent the set of geobody voxels. The combination of these sets, i.e., (W,G), denotes all valid completions. Associated with each such valid completion is a "quality". The formulation defines a set of binary variables, Y(W,G), to be binary variable array having 0/1 values to indicate the presence/absence of a completion. Q(W,G) is the array of associated "quality" values.

Next, spacing constraints need to be enforced on different well completions within a geobody (intra-geobody). Note that inter-geobody completions are not constrained. It is observed that these constraints can be defined by considering one geobody at a time, and writing the set of well spacing constraints as shown in equations (5) and (6).

An interesting aspect of this problem is the formulation of the objective function, as it is desired to trade-off maximizing the overall "quality" of the selected well locations against the cost of drilling and completing the wells. The first term in the objective function serves to maximize the cumulative quality of the selected locations:

$$\text{Max}\sum_{W}\sum_{G} QY \tag{7}$$

The fiscal terms are as follows: If a well is singly completed, it incurs a specified cost, say $\alpha$. Additional completions are treated as being some fraction of this cost, say $\frac{1}{2}\alpha$ each. To model this cost structure a fixed cost term is defined equal to $\frac{1}{2}\alpha$, which is incurred when a well is completed. It can be easily shown that this formulation represents the desired cost structure. However, to represent this quantitatively, an additional variable is necessary to model the selection of a well site. (Recall that the variable Y now denotes that the completion of a well in a geobody, and not the selection of well site.) The binary array X(W) is therefore defined to indicate the presence/absence of a well in the set of planar locations W, i.e., the (x, y) domain of the map. Since all completions are for strictly vertical wells, only one X(x, y) location variable is introduced for all corresponding Y(x, y, z) variables. The proposed cost structure can be incorporated into the objective function as:

$$\text{Max}\sum_{W}\sum_{G} Q(W,G)Y(W,G) - \frac{\alpha}{2}\sum_{W} X(W) - \frac{\alpha}{2}\sum_{W}\sum_{G} Y(W,G) \tag{8}$$

The two sets of binary variables Y and X are related, and the relationship can be stated:

$$X(W) \geqq Y(W,G),\ \forall G \tag{9}$$

The above set of equations ensure that if a well is completed in a geobody, i.e., if any of the binary variables, Y(W,G), is equal to 1, then the associated well drilling site, X(W), is also equal to 1. The converse of this statement, i.e. "if all completions associated with a well site are not selected, i.e., Y(W,G) is zero, then the associated binary variable X(W), is zero", is assured by the objective function given in equation (8), since X(W) is part of the negative cost term in an objective function that is being maximized. In fact, one can see that the variables, X(W), need not even be explicitly declared to be of type binary, but may be treated as a continuous variable bounded between 0 and 1. The form of the objective function, and the constraint representation shown above, ensure that X(W) can only take on the appropriate integral values.

The final model to determine the optimal set of well sites and strictly vertical completions in a 3D-reservoir model is:

$$\text{Max}\sum_{W\cap G} Q(W,G)Y(W,G) - \frac{\alpha}{2}\sum_{W} X(W) - \frac{\alpha}{2}\sum_{W\cap G} Y(W,G) \tag{10}$$

subject to the following constraints:

$$Y_i(W,G) + Y_j(W,G) \leq 1,\ \left\{ j \mid i \neq j,\ \frac{D_{\min}}{2} < D_{ij} \leq D_{\min} \right\},\ i, j \in (W,G) \tag{11}$$

$$Y_i + \sum_{J} Y_j \leq 1,\ \left\{ j \mid i \neq j,\ D_{ij} \leq \frac{D_{\min}}{2} \right\},\ i, j \in (W,G) \tag{12}$$

$$\sum_{i} X_i(W) \leq N_{\max} \tag{13}$$

$$X(W) \geqq Y(W,G),\ \forall G \tag{14}$$

$$Y(W,G) \epsilon \{0,1\} \tag{15}$$

$$0 \geqq X(W) \leqq 1 \tag{16}$$

The bottleneck in the formulation shown above is still the calculation and specification of the constraints to ensure that wells completed within the same geobody are separated by at least $D_{min}$. This effort is directly related to the number of voxels, i.e., potential completions, in a geobody, as the constraints have to be defined for all "pair combinations" of such completions that are spaced less than $D_{min}$. Thus, 3-D maps which are highly connected, i.e., are composed of a few, densely populated geobodies (~$10^6$ potential completions per geobody) can be time consuming to define and solve. However, as inter-geobody constraints are not enforced, large reservoirs that are heterogeneous with disconnected pay zones can be solved efficiently.

To illustrate the advantages of the above method, its performance is contrasted with a "greedy" procedure. The greedy procedure sequentially selects the well locations in descending order of reservoir "quality", while honoring the constraints of well spacing. The steps in such a procedure are:

1. At each planar location W, determine the maximum quality in the column of voxels as its representative "quality"
2. Eliminate from consideration locations with qualities below the minimum cutoff value
3. Select highest quality well completion location remaining
4. Eliminate from future consideration all remaining locations in the same geobody that are within $D_{min}$ of the well completion selected
5. If the number of locations selected is less than the maximum allowed, return to step 3.
6. Compute cumulative quality and cost of locations selected to determine final objective function value.

The set of well locations selected using the greedy-type algorithm can be sub-optimal, as there is no systematic way to quantify and backtrack to correct less than optimal decisions made earlier. In one comparison between the two methods, the optimal solution yielded, for 10 wells with 18 completions in multiple geobodies, a total quality 47% greater than the greedy solution. The optimal solution has a 13% increase in cost, assuming a second completion in a well is ½ the well cost.

Well Configuration

The second stage of the well placement and configuration strategy involves determining the configurations of the wells that were placed in the first stage. This stage involves a new mathematical formulation that designs a horizontal and/or highly deviated well path using the set of vertical completions determined earlier as a starting point. The objective is to increase hydrocarbon productivity overall, and in doing so, to determine if disconnected pay zones, which would have each required individual, vertically completed wells to produce, can be exploited with fewer wells.

Figure 6:
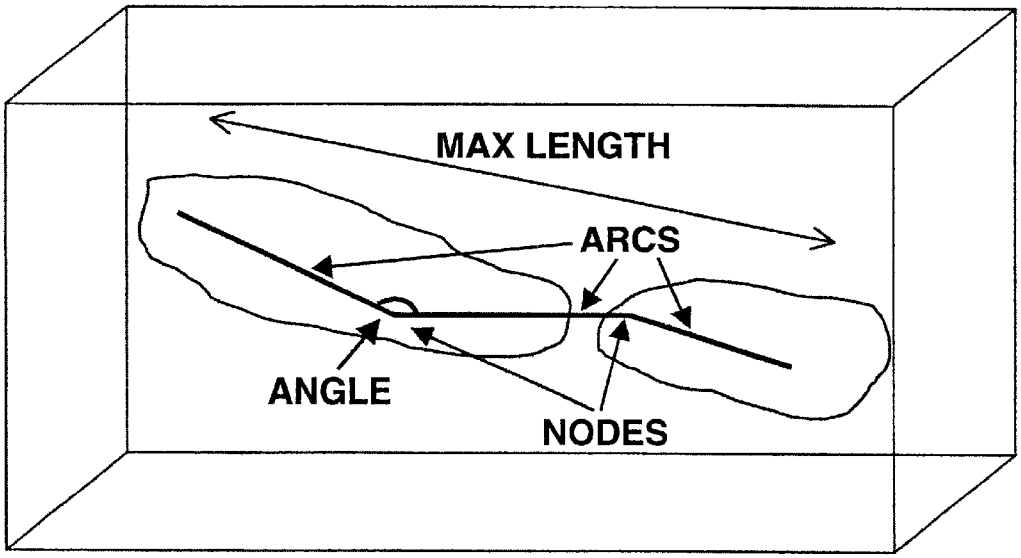
FIG. 6 is a schematic illustration of a deviated well.

FIG. 6 shows a deviated well connecting high reservoir quality locations. Conceptually, the problem is one of designing a deviated completion trajectory given a 3D spatial distribution of grid points with associated "qualities", i.e., in a cube (or cuboid) around a previously selected vertical completion location. The problem constraints include maximum well length, maximum bending angle, and a minimum spacing between intrabody completions.

Graph theory provides useful models for this problem. A graph G=(V,E) consists of a finite, nonempty set of vertices V=(1,2, . . . , m) and a set of edges $E=\{e_1, e_2, \ldots, e_n\}$ whose elements are subsets of V of size 2, that is, $e_k=(i,j)$, where $i,j \epsilon V$. The elements of V are often called. "nodes". Thus, graphs provide a convenient mechanism for specifying certain pairs of sets. An important attribute of a graph is a "walk", which is a connected sequence of edges. A formal definition of a walk is: A node sequence, $v_0, v_1, \ldots, v_k$, $k \geqq 1$, where $(v_{i-1}, v_i) \epsilon E$ for i=1, . . . , k. A walk is called a "path" if there are no node repetitions. Node $v_0$, is called the "origin" node, node $v_k$ is called the "destination" node, and nodes $(v_1, \ldots, v_{k-1})$ are "intermediate" nodes[4].

One can envision the grid points of a given 3D map as the "nodes" of a graph. Associated with each node is a certain value of the desired reservoir property. A horizontal and/or deviated well trajectory can be a "path" that connects a subset of these nodes. The origin node in this path would represent the beginning of a completion and the destination node its end. The intermediate nodes correspond to the pay areas that are contacted by the well trajectory; the corresponding "edges" denote the completion segments of the well. Now, the task of delineating an "optimal" deviated completion path is analogous to solving an optimization problem that selects the best path, i.e., the best subset of nodes whose reservoir properties contribute to the highest possible objective function value. This sequence of nodes denotes the ideal length, trajectory, and azimuth of a horizontal or highly deviated well that has the maximum contact area or productivity within the given 3D volume.

Additionally, one has to ensure that the well configuration is feasible. The three types of feasibility constraints considered are: the well spacing is greater than $D_{min}$; the azimuth of the completion path is. within a specified deviation from horizontal; and the. total length of the completion path is within the physical limits of current drilling techniques. FIG. 6 is a schematic of the formulation components. We will now consider these one at a time.

To maintain the problem complexity within feasible bounds, the deviated wells are considered one-at-a-time. The well spacing constraints between deviated wells are imposed after the trajectory optimization by eliminating all grid points within a cube of side $D_{min}$ around previous well trajectories from further consideration. This sequential procedure is dependent on the order in which the wells are configured, and can lead to solutions that are sub-optimal.

To ensure that the well completion can be designed in actual practice, we need to ensure that the azimuth of the trajectory is within a permitted angle of deviation from 180°. In other words, the bending angle between edges of the graph must be less than a predetermined value, say 5°.

It is noted that one method for formalizing these constraints begins by defining binary variables that represent the existence/non-existence of the grid points (nodes) in the final trajectory. However, it is preferred to define binary variables that represent the "edges" of the graph. It is further noted that the graph is not directed, i.e., edges (i,j) and (j,i) are the same. Consequently, for a graph composed of M nodes, only ${}^{M}C_2$ distinct edges need consideration.

To formalize the constraints, we first determine the angle between every pair of edges in the graph. Here, we resort to the formulas from Solid Analytic Geometry to determine the cosine of an angle. Consider any two edges (or equivalently three nodes) in a graph. The (x,y,z) coordinates of the nodes are known, and hence, the straight line distance between them (the length of the edges) can be computed. Then the direction cosines of the lines joining these points (edges) can be determined; finally, using these direction cosines, the cosine of the angle between the two edges can be calculated. Other angle calculation methods may also be used. The computed angle can be tested against the specified tolerance. If the angle is violated, then the associated pair of edges is an infeasible combination.

To mathematically represent an infeasible pair constraint, let the sets (W) and (W') both represent potential completion points in a space around a completed vertical well, and let (W,W') represent the set of ordered pairs of the two sets (W) and (W') that represents all connections between possible completion points. Y(W,W') is a binary-variable array that has 1's for the selected set of connection between possible completion points and zeros elsewhere. Then, mathematically this constraint can be formulated as a "node-packing" type representation:

$$Y_i(W, W') + Y_j(W, W') \leqq 1 \tag{17}$$

wherever $Y_i(W,W')$ and $Y_j(W,W')$ are jointly infeasible. Using this equation may require a very large number of such constraints to ensure a good formulation. Further, the effort to define these constraints is nearly $M^3$, where M is the number of nodes in a graph. As the computational expense to define all the constraints can be time consuming even for reasonable values of M, it may be preferred to limit the number of nodes considered in a 3D volume for each horizontal trajectory problem to a subset of the full number of nodes. The size of this subset depends on the available computer speed, but is often on the order of several hundred.

To model the constraints which imposes a cap on the total length of a deviated completion we note that the lengths of all the edges, Let L(W,W') represent the length of the connections (W,W'). L(W,W'), can be pre-calculated. Using the same notation as before, this constraint can be mathematically written as:

$$\sum_{W} \sum_{W'} Y(W, W') * L(W, W') \leq L_{\max} \tag{18}$$

where L(W,W') and $L_{max}$ are known quantities. Thus, if an edge is included in the optimal trajectory, i.e., its associated binary variable Y(W,W') is equal to one, then the length of that edge will contribute toward the total length of the completion.

To ensure that the node sequence selected by optimization represents a "path" of the graph, a constraint is made to verify that there is no repetition of nodes. This may be done by imposing constraints that the "degree" of a node is one in the final solution, i.e., (1) At most one arc is incident on a node, and (2) At most one arc is directed away from a node. Mathematically, these constraints can be represented as:

$$\sum_{W} Y(W, W') \leq 1 \quad \text{and} \quad \sum_{W'} Y(W, W') \leq 1 \tag{19}$$

To maximize the overall quality of the well trajectory computed, the objective function is preferably expressed as the sum of the qualities for the nodes that are selected by the optimization algorithm. So, we introduce an additional set of binary variables, X(W), that represent the set of nodes, V, of the graph. The two sets of binary variables, X and Y, are related by the logical proposition: A node X(W) is "on" if and only if an associated arc, Y(W, W') or Y(W', W,), is "on". X(W) thus has 1's at the selected potential completion points, and zeros elsewhere. Let Q(W) represents the predetermined, associated "quality" of these completions.

The "if" clause of the above proposition can be shown to be mathematically equivalent to the following two sets of equations:

$$X(W) \geq \sum_{W'} Y(W, W') \text{ and } X(W) \geq \sum_{W'} Y(W', W) \tag{20}$$

To model the "only if" sub-clause of the proposition, it is necessary to ensure that if the set of edges either incident or directed away from a node, W, are not selected, i.e., Y(W', W) or Y(W ,W') are all zero, then the associated node, X(W), is also zero. To ensure that X(W) is exactly zero in this situation, we state the following proposition: The number of nodes in a path is exactly one more than the number of edges.

This is true for each well trajectory determined by optimization. By extension, it can be shown that when multiple wells are simultaneously configured, the number of nodes selected less the number of edges selected is equal to the number of wells. The above proposition ensures that for the situation described earlier that X(W) will be zero.

With this formulation, the variables X(W) need not be explicitly declared to be of type binary, but may be declared as a continuous variable bounded between 0 and 1. The constraints shown above and the above proposition ensure that X(W) can only take on the appropriate integral values.

The final model to determine an optimal horizontal/deviated well trajectory in a 3D-reservoir model is:

$$\text{Max} \sum_{W} Q(W)X(W) \tag{21}$$

subject to the constraints:

$$\sum_{W} Y(W, W') \leq 1 \tag{22}$$

$$\sum_{W'} Y(W, W') \leq 1 \tag{23}$$

-continued $$\sum_{W} \sum_{W'} Y(W, W') * L(W, W') \leq L_{\max} \tag{24}$$

$$Y_i(W, W') + Y_j(W, W') \leq 1 \{i, j \mid \theta > 180 + tol\} \tag{25}$$

$$X(W) \geq \sum_{W'} Y(W, W') \tag{26}$$

$$X(W) \geq \sum_{W'} Y(W', W) \tag{27}$$

$$\sum_{W} X(W) - \sum_{W} \sum_{W'} Y(W, W') = N_{\max} \tag{28}$$

$$Y(W,W') \epsilon \{0,1\} \tag{29}$$

$$0 \leqq X(W) \leqq 1 \tag{30}$$

Figure 7:
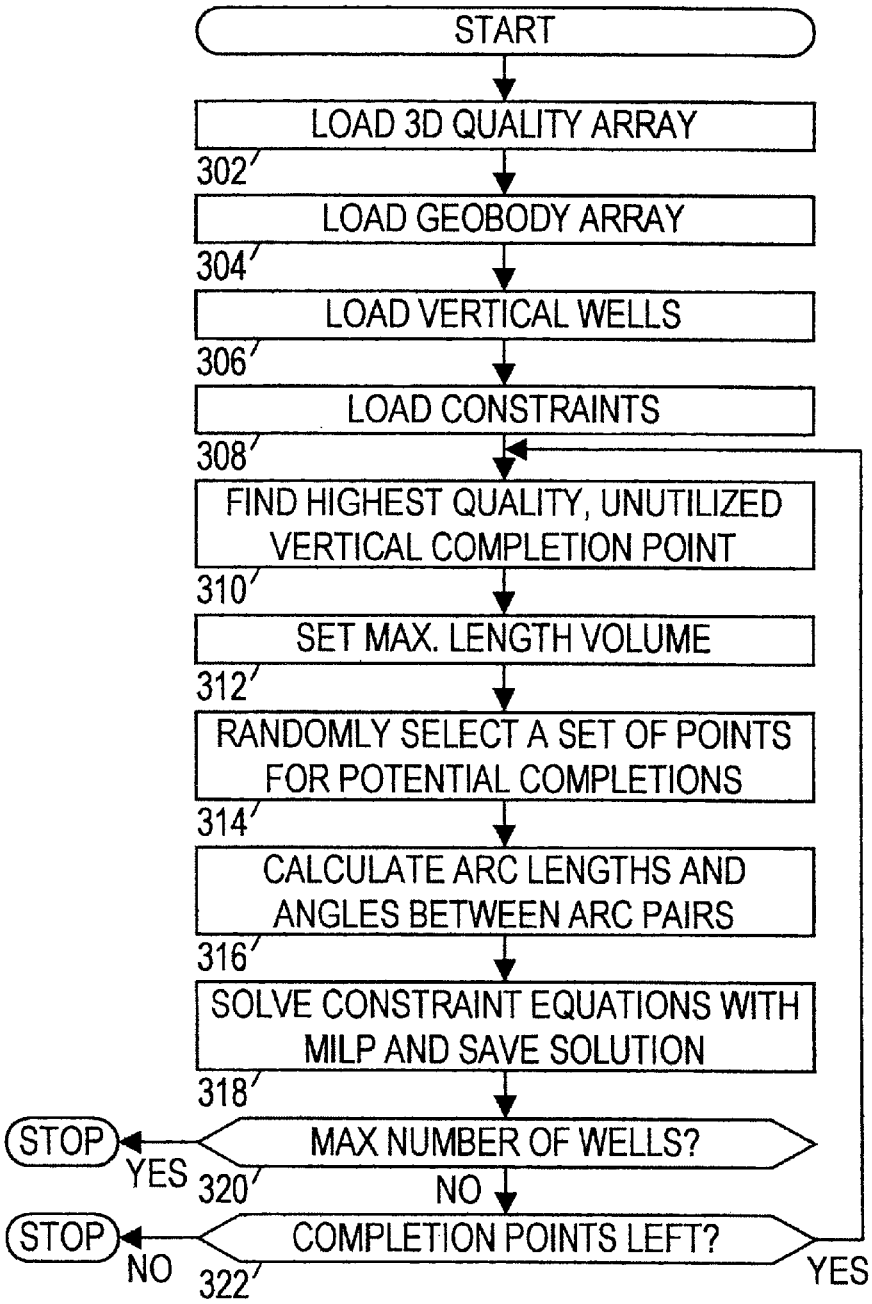
FIG. 7 is a flowchart of the horizontal/deviated well path selection method.

FIG. 7 shows a preferred method for determining optimal horizontal/deviated well completions. In blocks 302–304, the 3D reservoir quality array and the geobody array are retrieved. The vertical well locations from the vertical well placement stage are retrieved in block 306. The constraints are loaded in block 308. The constraints include maximum well length, maximum number of horizontal/deviated wells, and maximum bending angle. Examples of other constraints which may also be used include minimum distance from a water or gas contact, total vertical relief allowed, restricting the well to always dip down or up from a starting location, distance from a platform, distance from a fault, total capital available.

In block 310, the method finds the highest quality, unutilized vertical completion point. Any geobody cell in the column of cells where a vertical well is located may be chosen as a vertical completion point. That cell is. unutilized if it does not contribute to the quality of a previously selected completion point.

In block 312, a volume is defined around the highest quality unutilized cell. The volume has a radius determined by the maximum well length constraint. In block 314, a set of potential completion points is selected from this volume. Eliminated from candidacy as completion points are non-geobody cells and utilized cells. The potential completion points are selected randomly, and the number of points is limited to some maximum number (such as 100) in order to keep the complexity manageable. The maximum is limited by the computer memory and processor speed. The number of presolve calculations increases as $n^6$; the number of binary variables increases as $n^2$, and the number of constraint equations increases as $n^3$, where n is the number of selected potential completion points.

In block 316, the lengths of all arcs between potential completion points in the set are calculated, and those arcs having lengths greater, than the maximum well length constraint are eliminated. The angles between all pairs of arcs are calculated, and those pairs having bending angles in excess of the constraint are labeled as invalid. In block 318, the optimal solution to equations (21)–(30) is found using mixed integer/linear programming (MILP). The optimal deviated well path is saved. In block 320 a test is made to determine if the maximum number of horizontal/deviated wells has been reached. In block 322 a test is made to determine if any unutilized vertical completion points remain. If the another well is allowed and at least none completion point remains, then the method returns to block 310. Otherwise, the method terminates.

The formulations were written in GAMS (Generalized Algebraic Modeling System) syntax. The models were solved using a parallel version of CPLEX© MIP solver on any Siticon Graphics SGI Onyx, and with a parallel version of the OSL© solver on an IBM SP2. A graphical user interface (GUI) is preferably provided for handling the data volumes and running the geobody identification, reservoir quality calculation, vertical well placement, and horizontal well placement components separately as needed. The interface preferably allows the user to select high and low cutoff criteria, six-point, eighteen-point, or twenty-six point searches, and other parameters such as drainage radius for the proposed wells, well spacing, horizontal well length and azimuth angle restrictions.

Numerous variations and modifications will become apparent to those skilled in the art once the above disclosure is fully appreciated. For example, the maximum bending angle may be made a function of the arc length, e.g. 13° per 60 meters. It is intended that the following claims be interpreted to embrace all such variations and modifications.

What is claimed is:

1. A method to determine locations for a plurality of wells, wherein the method comprises:

receiving a well productivity proxy value for each voxel of a seismic derived property data volume;

processing the well productivity proxy values to identify geobodies;

computing a reservoir quality value for each voxel in the geobodies; and using integer programming to locate completion point voxels that maximize a sum of associated reservoir quality values subject to specified constraints.

2. The method of claim 1, wherein the seismic derived property data volume is a three-dimensional data volume for a petroleum geologic formation having heterogeneous geologic properties and heterogeneous fluid distributions.

3. The method of claim 1, wherein the three-dimensional volume is a property volume derived from mapping or geostatistical modeling from existing well data.

4. The method of claim 1, wherein the well productivity proxy value is one of a set of proxy values, the set including porosity, net pay, permeability, permeability thickness, and pore volume.

5. The method of claim 1, wherein said processing of well productivity proxy values includes:

reassigning all well productivity proxy values below a selected minimum cutoff value to 0;

determining geobody volumes by slimming volumes of connected voxels having nonzero well productivity proxy values; and assigning index values to geobodies in order of decreasing geobody volume.

6. The method of claim 1, wherein said processing of well productivity proxy values includes:

designating all voxels having a well productivity proxy values below a selected minimum cutoff value as inactive, and all voxels having a well productivity proxy value equal to or greater than the selected minimum cutoff value as active;

determining geobody volumes by summing volumes of connected active voxels;. and assigning index values to geobodies in order of decreasing geobody volume.

7. The method of claim 6, wherein said computing a reservoir quality value of a given voxel includes:

summing well productivity proxy values of all active voxels connected to the given voxel that are within a well drainage radius of the given voxel.

8. The method of claim 1, wherein computing a reservoir quality value of a given voxel includes:

simulating three-dimensional paths of a random walker from the given voxel to a boundary, wherein the boundary is determined by any one of a set including a drainage radius, a geobody boundary, and a no-flow boundary; and summing well productivity proxy values of all voxels touched by at least one random walker path.

9. The method of claim 1, wherein using integer, programming involves a set of constraints that includes: a maximum number of wells; a minimal distance between wells completed in a shared geobody; a maximum distance from an offshore platform; a maximum capital drilling cost; and a minimum distance from water-oil contacts, gas-oil interface contacts, faults, and other reservoir formation boundaries.

10. The method of claim 1, wherein using integer programming to locate completion point voxels includes:

$$\text{maximizing}\left[\sum_{(W,G)} Q(W,G)Y(W,G) - \alpha\sum_{W} X(W) - \beta\sum_{(W,G)} Y(W,G)\right]$$

subject to the following constraints:

$$Y_i(W,G) + Y_j(W,G) \le 1,\ \left\{j \mid i \ne j,\ \frac{D_{\min}}{2} < D_{ij} \le D_{\min}\right\},\ i,\ j \in (W,G)$$

$$Y_i + \sum_j Y_j \le 1,\ \left\{j \mid i \ne j,\ D_{ij} \le \frac{D_{\min}}{2}\right\},\ i,\ j \in (W,G)$$

$$\sum_i X_i(W) \le N_{\max}$$

$$X(W) \ge Y(W,G),\ \forall\, G$$

$$Y(W,G) \in \{0,1\}$$

$$0 \le X(W) \le 1$$

where W represents a set of potential surface well sites, G represents a set of geobody voxels, (W[∩],G) represents all valid completions, Q, (W[∩],G) represents a quality value associated with each such valid completion, Y, (W[∩],G) represents a binary variable having values to indicate the presence or absence of a completion, X(W) represents a variable defined to indicate the presence or absence of a well in the set of potential well surface sites W, α represents a cost of a well, and δ represents a cost of completion.

11. The method of claim 1, further comprising:

finding an unexploited voxel having a maximum quality value;

randomly selecting a predetermined number of voxels within a predetermined radius of the unexploited voxel;

calculating arc lengths between all pairs of selected voxels;

calculating angles between all pairs of connected arcs; and using integer programming to determine a deviated well completion path.

12. The method of claim 10, further comprising:

repeating said finding, selecting, calculating, and integer programming steps if unexploited voxels remain, and if a maximum number of deviated wells is not exceeded.

13. The method of claim 11, wherein using integer programming to determine a deviated well completion path includes:

$$\text{maximizing} \sum_{W} Q(W)X(W) \text{ subject to the following constraints:}$$

$$\sum_{W} Y(W, W') \leq 1$$

$$\sum_{W'} Y(W, W') \leq 1$$

$$\sum_{W} \sum_{W'} Y(W, W') * L(W, W') \leq L_{\max}$$

$$Y_i(W, W') + Y_j(W, W') \leq 1 \ \{i, j \mid \theta > 180 + tol\}$$

$$X(W) \geq \sum_{W'} Y(W, W')$$

$$X(W) \geq \sum_{W'} Y(W', W)$$

$$\sum_{W} X(W) - \sum_{W} \sum_{W'} Y(W, W') = N_{\max}$$

$$Y(W,W') \epsilon \{0,1\}$$

$$0 \leq X(W) \leq 1$$

where W and W' both represent a set of potential completion points in a space around a completed vertical well, Q(W) represents a quality value associated with each completion point, X(W) represents a variable array defined to indicate the presence or absence of each completion, (W,W') represents all connections between possible completion points in W and W', Y(W,W') represents a binary-variable array that indicates selected connections between possible completion points, L(W,W') represents a length associated with each of the connections, $L_{max}$ represents a predetermined maximum length, and tol represents a predetermined angular tolerance.

14. A method for calculating a reservoir quality value for a cell in a three-dimensional seismic volume, wherein the method comprises:

simulating a predetermined number of three-dimensional random walks from the cell to a boundary, wherein the boundary is determined by limits that include a drainage radius and a geobody boundary; and summing well productivity proxy values of all cells included in at least one random walker path.

15. The method of claim 14, wherein the well productivity proxy value is one of a set of proxy values, the set including porosity, net pay, permeability, permeability thickness, and pore volume.

16. A method for identifying geobodies from a data volume, wherein the method comprises:

selecting from the data volume a property as a proxy for well productivity;

generating a geobody number array with elements that correspond to cells in the data volume, wherein elements that correspond to data volume cells having property values below a chosen cutoff are assigned a first flag value and all remaining cells are assigned a second flag value;

systematically searching the geobody number array for elements having the second flag value, and for any current element found having the second flag value:

incrementing a geobody counter;

assigning the current element the geobody counter value; and performing a loop to assign all elements connected to the current element the geobody counter value.

17. The method of claim 16, wherein said performing a loop includes:

initializing a visited element array to zero;

initializing a first visited element counter and a second visited element counter;

assigning a first member of the visited element array a location of the current element;

setting a present location equal to a member of the visited element array indicated by the second visited element counter;

for each neighboring element of the present location that has the second flag value:

assigning the neighboring element the geobody counter value;

incrementing the first visited element counter;

assigning a location of the neighboring element to a member of the visited element array indicated by the first visited element counter; and incrementing the second visited element counter.

18. The method of claim 17, wherein the neighboring elements include all elements sharing a face with the element at the present location.

19. The method of claim 18, wherein the neighboring elements further include all elements sharing an edge with the element at the present location.

20. The method of claim 19, wherein the neighboring elements further include all elements sharing a vertex with the element at the present location.

21. The method of claim 16, further comprising:

determining a size for each geobody; and indexing the geobodies in order of decreasing size.

22. The method of claim 16, wherein the property is one of a set of properties that includes porosity, net pay, permeabilty, permeability-thickness, and pore volume.

23. A method to determine a path for a deviated well, wherein the method comprises:

receiving a well productivity proxy value for each voxel of a seismic data volume;

processing the well productivity proxy values to identify geobodies;

computing a reservoir quality value for each voxel in the geobodies; and finding an unexploited voxel having a maximum quality value below a selected well site;

randomly selecting a predetermined number of voxels within a predetermined radius of the unexploited voxel;

calculating arc lengths between all pairs of selected voxels;

calculating angles between all pairs of connected arcs; and using integer programming to determine a deviated well completion path that maximizes a sum of quality values.

24. The method of claim 23, wherein using integer programming to determine a deviated well completion path involves a set of constraints that includes: a minimum distance between completions in a shared geobody; a maximum deviation from linear over a specified distance; a maximum well length; and a minimum distance from water-oil contacts, gas-oil interface contacts, faults, and other reservoir formation boundaries.

25. The method of claim 24, wherein using integer programming to determine a deviated well completion path includes:

$$\text{maximizing} \sum_{W} Q(W)X(W) \text{ subject to the following constraints:}$$

$$\sum_{W} Y(W, W') \leq 1$$

$$\sum_{W'} Y(W, W') \leq 1$$

$$\sum_{W} \sum_{W'} Y(W, W') * L(W, W') \leq L_{\max}$$

$$Y_i(W, W') + Y_j(W, W') \leq 1 \ \{i, j \mid \theta > 180 + tol\}$$

$$X(W) \geq \sum_{W'} Y(W, W')$$

$$X(W) \geq \sum_{W'} Y(W', W)$$

-continued $$\sum_{W} X(W) - \sum_{W} \sum_{W'} Y(W, W') = N_{\max}$$

$$Y(W,W') \epsilon \{0,1\}$$

$$0 \leq X(W) \leq 1$$

where W and W' both represent a set of potential completion points in a space around a completed vertical well, Q(W) represents a quality value associated with each completion point, X(W) represents a variable array defined to indicate the presence or absence of each completion, (W,W') represents all connections between possible completion points in W and W', Y(W,W') represents a binary-variable array that indicates selected connections between possible completion points, L(W,W') represents a length associated with each of the connections, $L_{max}$ represents a predetermined maximum length, and tol represents a predetermined angular tolerance.

* * * * *